US007555907B2

(12) United States Patent
Bang

(10) Patent No.: US 7,555,907 B2
(45) Date of Patent: Jul. 7, 2009

(54) REFRIGERATING STORAGE USING THERMOELECTRIC ELEMENT

(75) Inventor: Woo Jong Bang, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 323 days.

(21) Appl. No.: 11/366,448

(22) Filed: Mar. 3, 2006

(65) Prior Publication Data

US 2007/0051113 A1 Mar. 8, 2007

(30) Foreign Application Priority Data

Sep. 8, 2005 (KR) ..... 10-2005-0083522

(51) Int. Cl.
*F25B 21/02* (2006.01)

(52) U.S. Cl. ..... 62/3.6; 62/419; 454/184

(58) Field of Classification Search ..... 62/3.2, 62/3.6, 408, 419; 454/184
See application file for complete search history.

(56) References Cited

U.S. PATENT DOCUMENTS

| | | | | |
|---|---|---|---|---|
| 5,775,124 | A * | 7/1998 | Park et al. | 62/408 |
| 6,077,160 | A * | 6/2000 | Franaszek et al. | 454/292 |
| 6,715,299 | B2 * | 4/2004 | Kim et al. | 62/3.6 |
| 2004/0118141 | A1 | 6/2004 | Kim et al. | |

FOREIGN PATENT DOCUMENTS

| | | |
|---|---|---|
| JP | 2001221551 A | 8/2001 |
| JP | 2002090034 A | 3/2002 |
| KR | 10-2002-0071222 | 9/2002 |

* cited by examiner

*Primary Examiner*—William E Tapolcai
(74) *Attorney, Agent, or Firm*—Bacon & Thomas, PLLC

(57) ABSTRACT

A refrigerating storage, includes a refrigerating compartment; a plurality of air inlets and air outlets formed in an inner wall of the refrigerating compartment; a duct for providing an air passage between the air inlets and the air outlets; a thermoelectric element, installed in the duct, for cooling down the air in the duct; and a blowing unit for drawing the air in the refrigerating compartment into the duct via the air inlets, and discharging the air cooled by the thermoelectric element into the refrigerating compartment via the air outlets.

5 Claims, 5 Drawing Sheets

REFRIGERATING STORAGE USING THERMOELECTRIC ELEMENT

FIELD OF THE INVENTION

The present invention relates to a refrigerating storage; and, more particularly, to a refrigerating storage having fast refrigerating speed and better temperature uniformity by blowing air cooled down by a thermoelectric element.

BACKGROUND OF THE INVENTION

Generally, a refrigerator is used to keep food or beverage in a refrigerated or frozen state for a long time or to cool them rapidly. The refrigerator includes a freezing compartment and a refrigerating compartment opened or closed by individual front doors. To supply cold air to the freezing compartment and the refrigerating compartment, the refrigerator has a compressor, a condenser, a capillary tube and a cooling device to perform a cooling cycle. The compressor compresses a coolant at a high temperature and pressure, and provides thus compressed coolant to the condenser. Then, the condenser condenses the compressed coolant at a low temperature and pressure by releasing heat of the coolant. The condensed coolant is then converted into a liquid state of a low temperature and a high pressure while it passes through the capillary tube. The low-temperature high-pressure condensed coolant is then directed to the cooling device installed at a rear side of the freezing compartment. The coolant sent to the cooling device is converted into a low-pressure state again while it passes through a coolant pipe in the cooling device, and finally evaporates, thereby reducing the temperature in the freezing compartment and the refrigerating compartment.

Recently, along with a rise in the living standard, there have been increasing demands for diversified types of special-purpose refrigerators. Developed to meet such needs are, for example, a kimchi refrigerator equipped with an evaporation pipe and a heating wire for the ripening of kimchi, a cosmetic cooler for storing cosmetics at a low temperature by cooling a cosmetic storage compartment with a relatively small volume by means of a thermoelectric element, and so forth.

A conventional refrigerator for cooling stored goods by using a thermoelectric element has been manufactured to have a direct type scheme in which the thermoelectric element directly makes contact with an aluminum box inside the refrigerator for cooling.

However, in the direct type refrigerator using the thermoelectric element, since the cold is transferred via the aluminum box, a cooling speed is low and it is difficult to transfer the cold uniformly all over the stored goods in the refrigerator. Thus, there are drawbacks in that it is difficult to achieve temperature uniformity and higher cooling efficiency.

Further, if the cooling speed is made higher due to the above drawbacks, power consumption is increased accordingly.

SUMMARY OF THE INVENTION

It is, therefore, an object of the present invention to provide a refrigerating storage having fast cooling speed and better temperature uniformity in a refrigerator.

In accordance with a preferred embodiment of the present invention, there is provided a refrigerating storage, which includes a refrigerating compartment; a plurality of air inlets and air outlets formed in an inner wall of the refrigerating compartment; a duct for providing an air passage between the air inlets and the air outlets; a thermoelectric element, installed in the duct, for cooling down the air in the duct; and a blowing unit for drawing the air in the refrigerating compartment into the duct via the air inlets, and discharging the air cooled by the thermoelectric element into the refrigerating compartment via the air outlets.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE INVENTION

Hereinafter, a preferred embodiment of the present invention will be described in detail with reference to the accompanying drawings.

Figure 1:
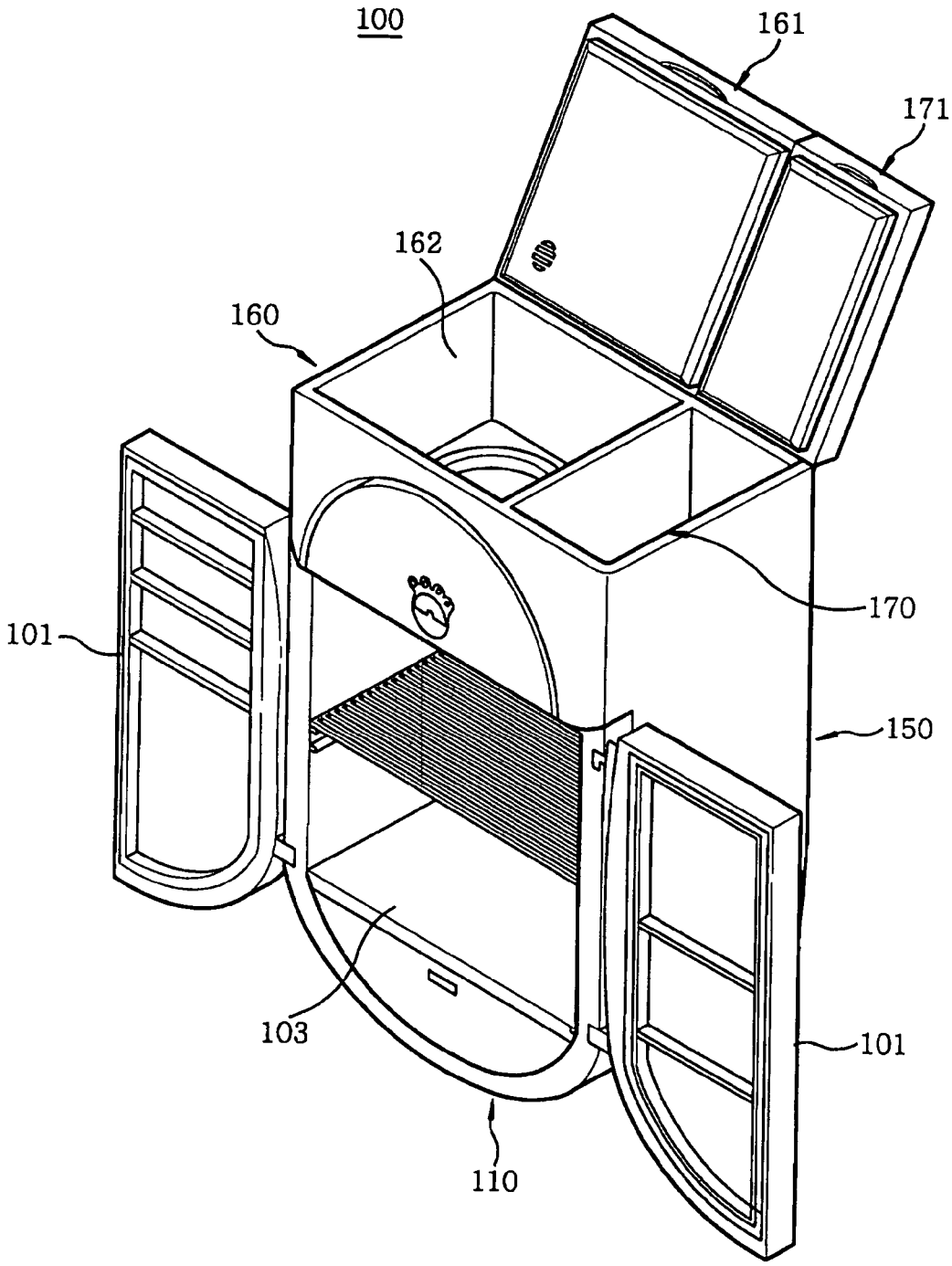
FIG. 1 shows a perspective view of a refrigerating storage in accordance with the present invention.
Figure 2:
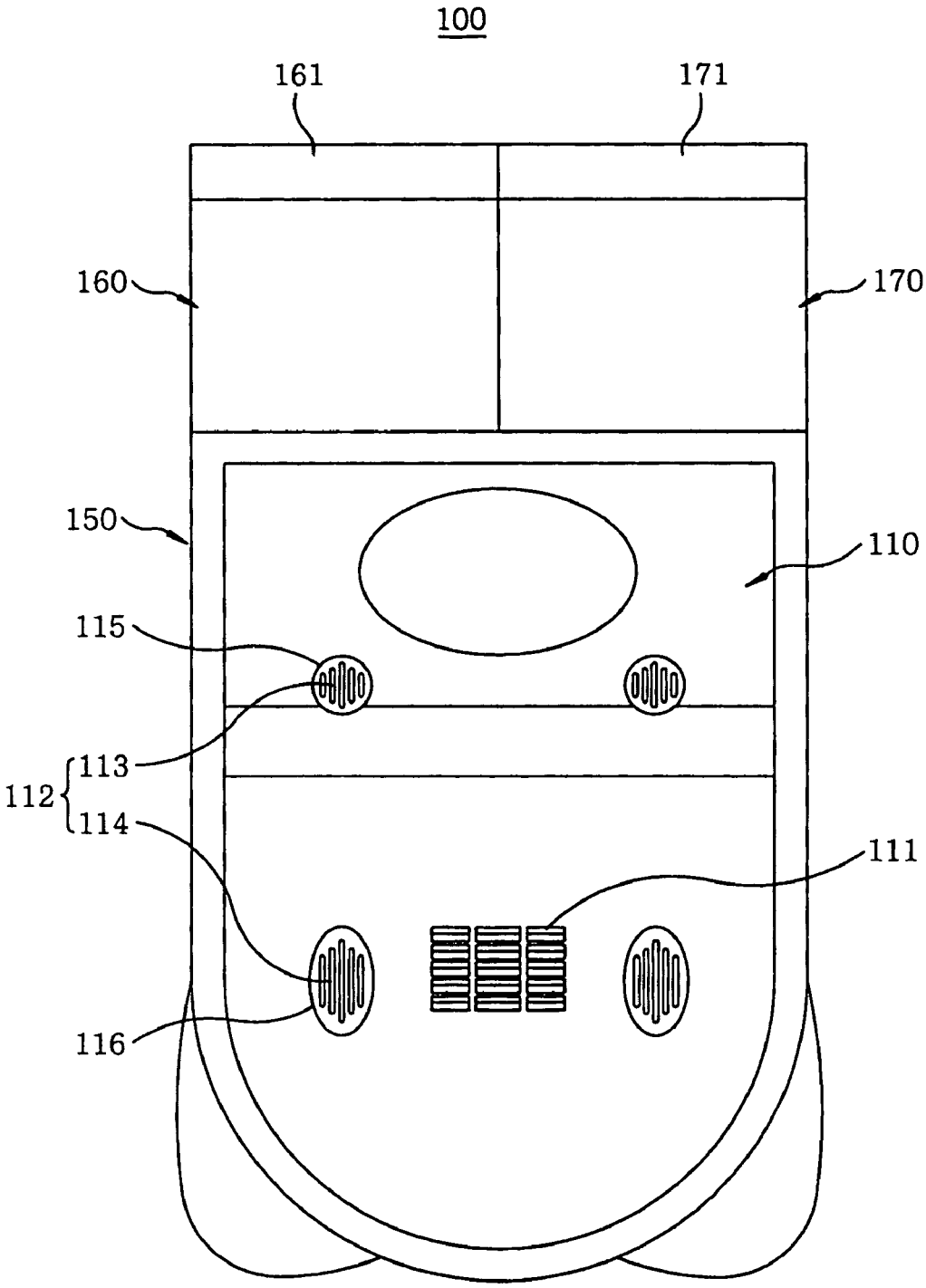
FIG. 2 is a front view of the refrigerating storage of FIG. 1, wherein doors are removed to reveal the inside of a refrigerating compartment.

FIG. 1 shows a perspective view of a refrigerating storage in accordance with the present invention; and FIG. 2 is a front view illustrating the inner wall of the refrigerating storage, wherein doors are removed to reveal the inside of the refrigerating storage of FIG. 1.

As shown, the refrigerating storage 100 is provided with a plurality of functional compartments 110, 160 and 170 in a main body 150 thereof. The plurality of functional compartments 110, 160 and 170 include a refrigerating compartment; a sterilizing compartment; and a warming-in-water compartment, respectively.

The refrigerating compartment 110 is opened and closed by doors 101 hinge-connected to edges of the main body 150 to define a refrigerating space 103.

The sterilizing compartment 160, provided at an upper portion of the main body 150, is opened and closed from above by a door 161 to define a sterilizing space 162 in the main body 150. In the sterilizing space 162, a stack mount (not shown) is installed, on which the infant products are placed. And the infant products placed on the stack mount (not shown) are sterilized by steam generated by a heater or ultraviolet rays of an ultraviolet ray sterilizing lamp.

The warming-in-water compartment 170 is provided at an upper portion of the main body 150, such that it is located next to the sterilizing compartment 160. The warming-in-water compartment 170 is opened and closed by a door 171. The warming-in-water compartment 170 is used to warm up breast milk or powdered milk filled in a feeding bottle and the like in such a manner that the feeding bottle is indirectly warmed up by water boiled by a heater.

Figure 3:
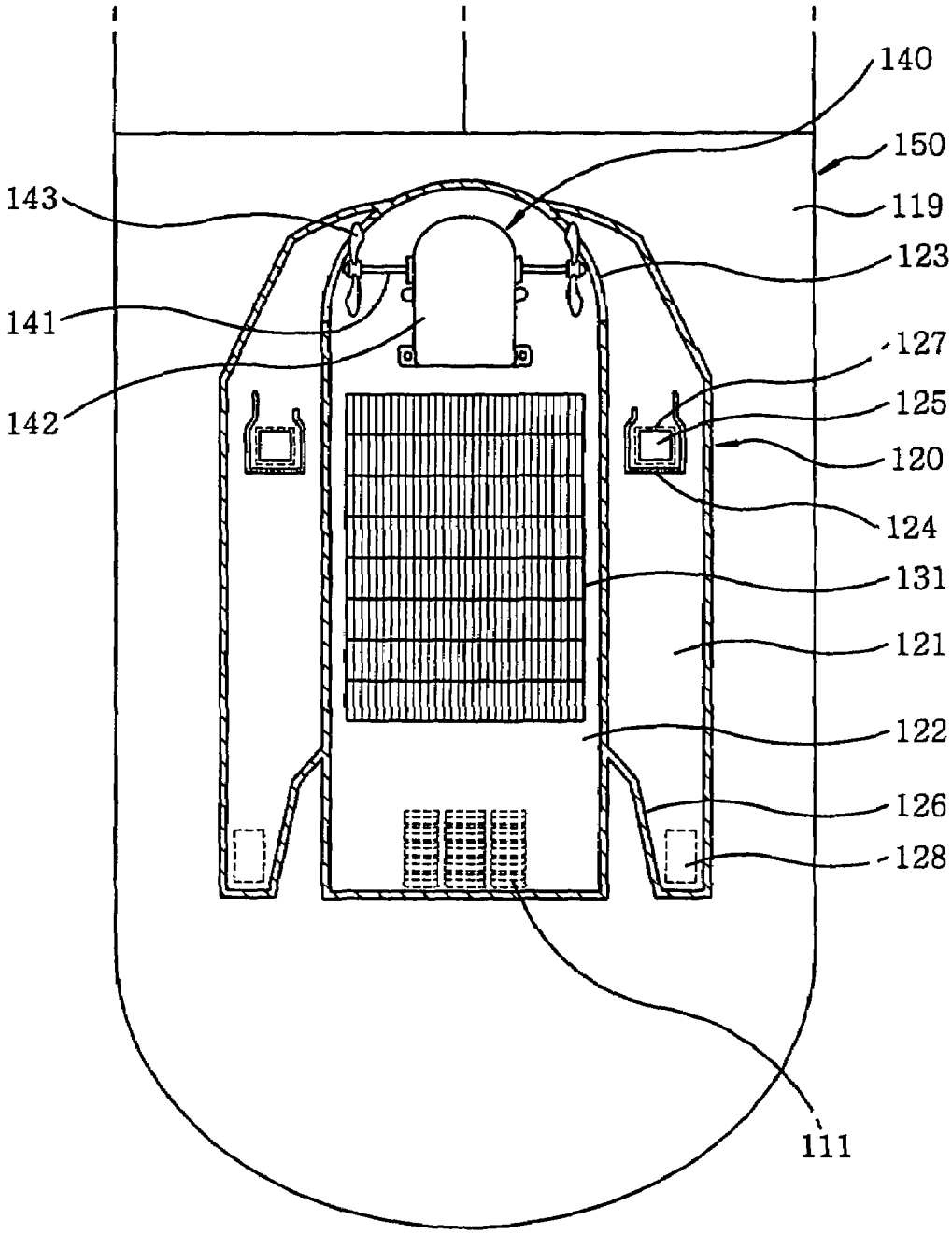
FIG. 3 shows a sectional rear elevation of the refrigerating storage of FIG. 1.
Figure 4:
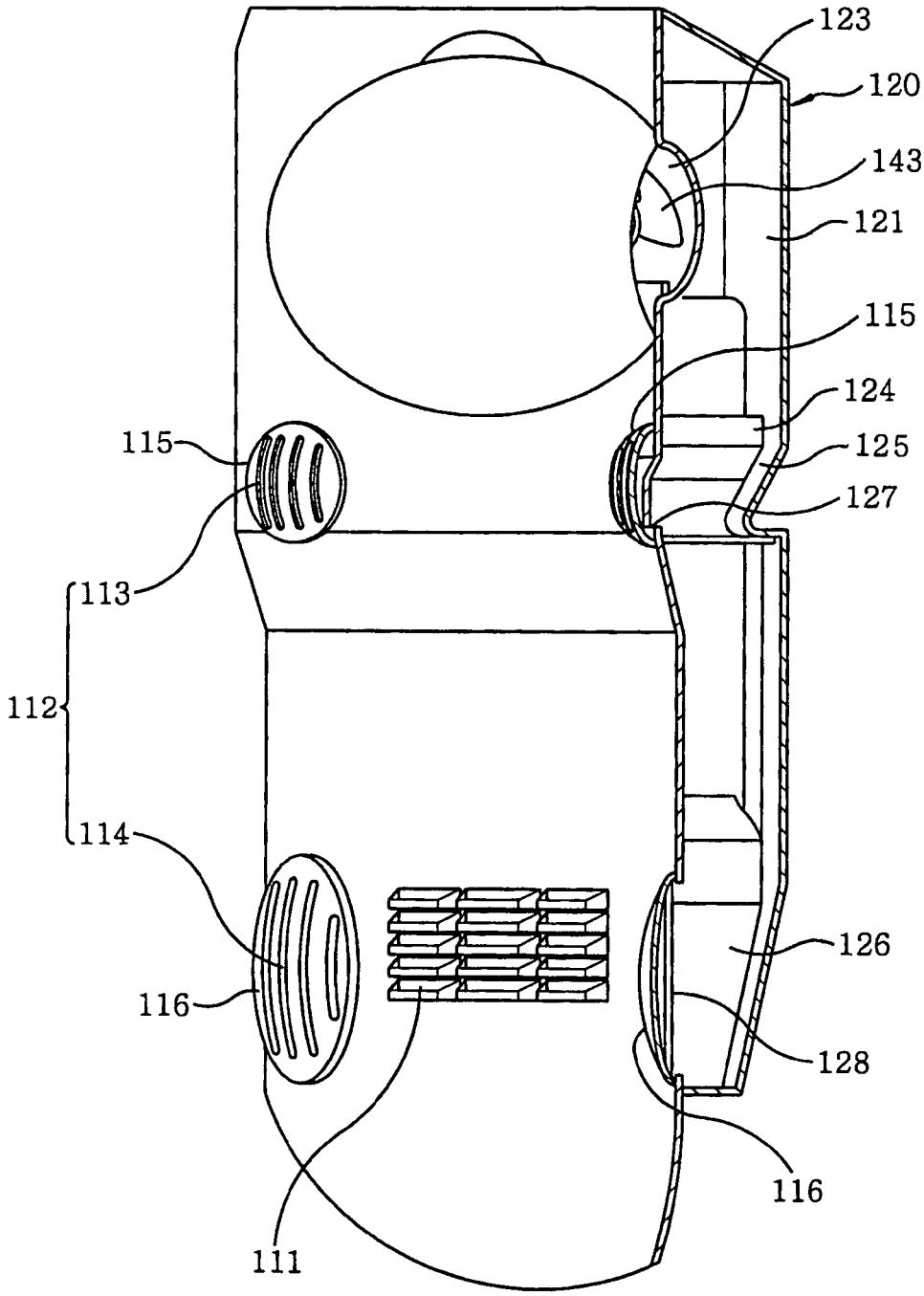
FIG. 4 is a partially cutaway, front perspective view of the refrigerating storage of FIG. 1.

FIG. 2 is a front view of the refrigerating storage of FIG. 1 with doors removed, FIG. 3 shows a sectional rear elevation of the refrigerating storage of FIG. 1, and FIG. 4 is a partially cutaway, front perspective view of the refrigerating storage of FIG. 1

As shown in these figures, the refrigerating compartment 110 includes a plurality of air inlets 111 and air outlets 112, a duct 120 to provide pathways between the air inlets 111 and the air outlets 112, and a blowing unit 140 placed inside the duct 120 to allow the air flowing.

The air inlets 111 and the air outlets 112 are separately provided on an inner wall of the refrigerating compartment 110. The air in the refrigerating compartment 110 is sucked through the air inlets 111 and is again discharged into the refrigerating compartment 110 through the air outlets 112.

Figure 5:
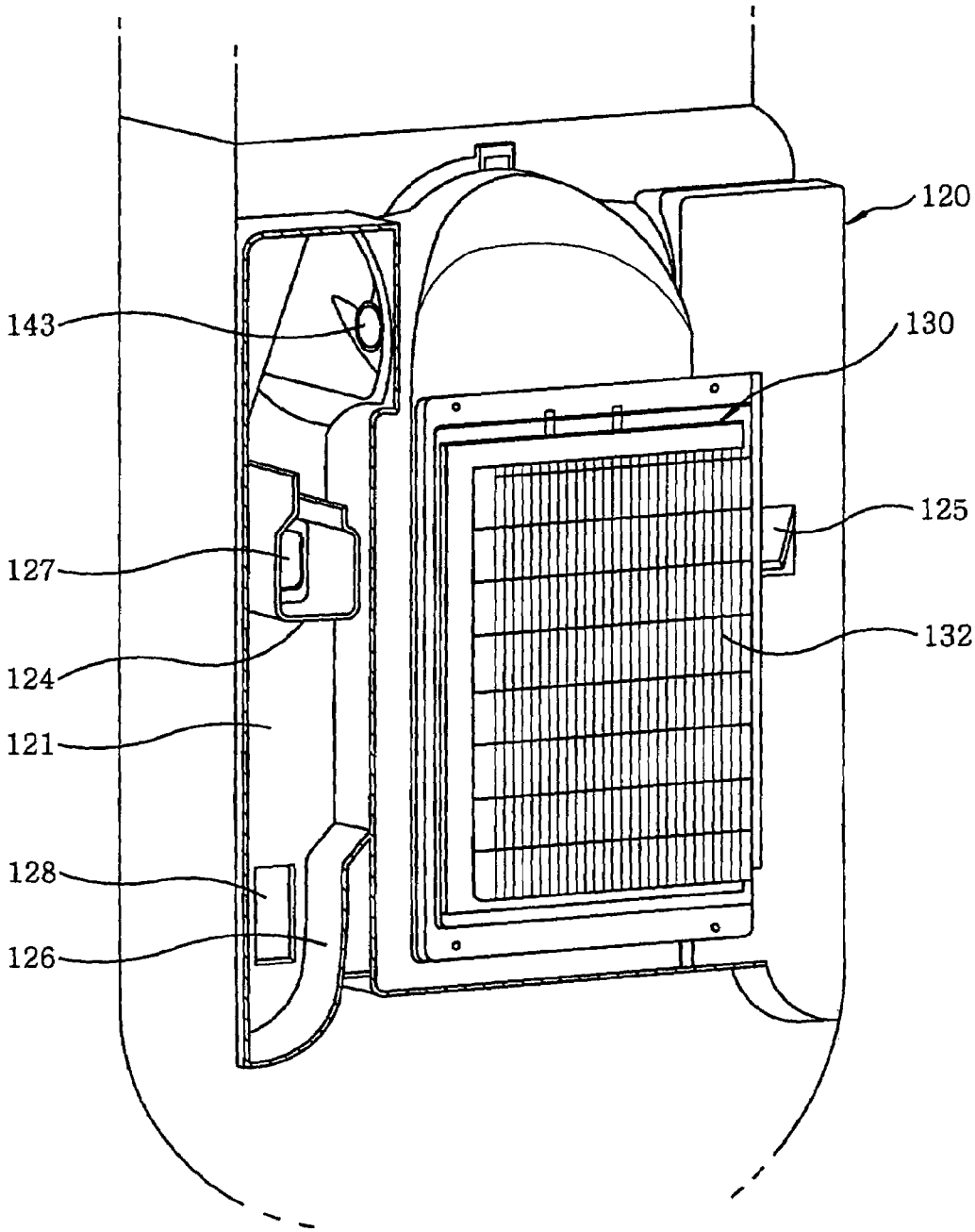
FIG. 5 is a partially cutaway, rear perspective view of the refrigerating storage of FIG. 1.

As shown in FIGS. 3 and 5, the duct 120 is installed on the rear side of the refrigerating compartment 110 to serve as an air passage between the air inlets 111 and the air outlets 112. More specifically, the duct 120 functions to guide the air sucked through the air inlet 111 and to be discharged through the air outlet 112. The duct 120 includes an air cooling passage 122 communicating with the air inlets 111 and a pair of cold air discharging passages 121 communicating with the air outlets 112. A thermoelectric element 130 and a blowing unit 140 are provided to cool down and flow the air in the air cooling passage 122.

The air cooling passage 122 communicates with the air outlets 112 through a pair of apertures 123 formed at the upper portion thereof. The cooled air by the thermoelectric element 130 flows into both the cold air discharging passages 121 through their corresponding apertures 123.

The cold air discharging passages 121 are disposed on the both sides of the air cooling passage 122.

The thermoelectric element 130 is installed such that a cold sink thereof is disposed in the air cooling passage 122 and a heat sink thereof is disposed outside.

In order to rapidly cool down the air in the duct 120, a plurality of cooling fins 131 are provided at the cold sink of the thermoelectric element 130 in the air cooling passage 122. On the other hand, a heat radiating fins 132 are provided at the heat sink of the thermoelectric element 130 outside the air cooling passage 122. When a direct current is applied to the contacts between the cold sink and the heat sink, heat absorption and heat radiation occur at the cold sink and the heat sink respectively, so that the air around the cold sink is cooled.

The blowing unit 140 serves to draw the air in the refrigerating compartment 110 into the air cooling passage 122 through the air inlets 111, and then discharge the air cooled by the thermoelectric element 130 into the refrigerating compartment 110 through the air outlets 112, thereby resulting in circulating of the air in the refrigerating compartment 110. In addition, the blowing unit 140, as shown in FIG. 3, includes a fan motor 142 installed at the air cooling passage 122 and provided with left and right rotation shafts 141 thereof, and a pair of fans 143 coupled to the left and right rotation shafts 141. The fans 143 rotate to blow the cold air passing through the air cooling passage 122 into the respective air discharging passages 121. The fans 143 are located to face the apertures 123 so that the cold air in the air cooling passage 122 flows into the cold air discharging passages 121 smoothly.

Meanwhile, the air outlet 112 includes a first outlet 113 and a second outlet 114 arranged on the interior wall of the refrigerating compartment 110 for the purpose of blowing the cold air into the refrigerating compartment 110. More specifically, a first and a second opening 127 and 128 is provided for connecting the cold air discharging passages 121 to the refrigerating compartment 110. The first openings 127 communicating with the first air outlets 113 are located at the middle of the cold air discharging passages 121, and the second openings 128 communicating with the second air outlets 114 are located at the end portion of cold air discharging passages 121 to discharge the remainder of the cold air which has not been discharged through the first air outlets 113. Moreover, in order to prevent most of the cold air from being discharged through the first air outlets 113, it is preferable to make the size of the first air outlets 113 smaller than that of the second air outlets 114. In addition, a first and a second air outlet cover 115 and 116 is employed to cover the first and the second air outlet 113 and 114, respectively.

The duct 120 further has a first U-shaped guide 124 for allowing the cold air to flow into the refrigerating compartment 110 through the opened portion thereof. Further, second guides 125 and 126 are formed such that the section area thereof near the air outlets 112 is gradually decreased, thereby allowing the cold air to be easily gathered toward the air outlets.

Following is a description on the operation of the cold storage configured as mentioned above.

First of all, the air in the refrigerating compartment 110 is drawn into the air cooling passage 122 via the air inlets 111 by the rotation of the fans 143.

The inhaled air is cooled down while passing through the cooling fins 131 of the thermoelectric element 130. The cooled air is distributed quickly to the cold air discharging passages 121 by the fans 143 of the fan motor 142, and then discharged throughout the first air outlets 113 and the second air outlets 114 in sequence. At this time, since the discharging area of the first air outlet 113 is smaller than that of the second air outlet 114, it is possible to prevent most of the air from being discharged into the refrigerating compartment 110 through the first air outlets 113. Further, the air can be discharged through the first air outlets 113 and the second air outlets 114 by the guides 124, 125 and 126.

Meanwhile, by discharging the heat from the thermoelectric element 130 through the heat radiating fins 132, the cooling efficiency of the thermoelectric element 130 can be maintained and protected from heating damage.

As described above, it is possible to enhance the cooling speed and transfer the cold uniformly to stored goods in the refrigerating compartment 110 by means of the duct 120, which brings into the reduction of the power consumption and the increase of a cooling efficiency.

What is claimed is:

1. A refrigerating storage, comprising:

a refrigerating compartment;

a plurality of air inlets and air outlets formed in an inner wall of the refrigerating compartment;

a duct for providing an air passage between the air inlets and the air outlets;

a thermoelectric element, installed in the duct, for cooling down the air in the duct; and a blowing unit for drawing the air in the refrigerating compartment into the duct via the air inlets, and discharging the air cooled by the thermoelectric element into the refrigerating compartment via the air outlets, wherein the air outlets include a first and a second air outlet formed in the duct, the first and the second outlet being arranged sequentially in an air flow direction in the duct and the first air outlet having a size smaller than that of the second air outlet.

2. The refrigerating storage as recited in claim 1, wherein the duct includes:

an air cooling passage communicating with the air inlets, the thermoelectric element being installed in the air cooling passage; and one or more cold air discharging passages communicating with the air outlets, the cold air discharging passages communicating with the air cooling passage so that the air cooled by the thermoelectric element flows into the cold air discharging passage to be discharged into the refrigerating compartment through the air outlets.

3. The refrigerating storage as recited in claim 2, wherein the cold air discharging passages are provided at both sides of the air cooling passage; and wherein the blowing unit includes:

a fan motor;

a pair of rotation shafts formed at both sides of the fan motor; and a pair of fans coupled to the respective rotation shafts, for forcing the air in the refrigerating compartment to flow through the air cooling passage into the cold air discharging passages.

4. The refrigerating storage as recited in claim 1, wherein the duct further includes:

a first U-shaped guide surrounding the first air outlet, for guiding the cold air to be discharged into the refrigerating compartment via the first air outlets; and a second guide formed such that the section area thereof near the air outlets is gradually decreased, thereby allowing the cold air to be easily gathered toward the air outlets.

5. The refrigerating storage as recited in claim 1, wherein the thermoelectric element includes:

a cold sink, installed in the air cooling passage, for absorbing heat of air passing therethrough; and a heat sink, installed outside of the air cooling passage, for radiating the heat absorbed to the outside.

* * * * *